US011133597B2

(12) United States Patent
Liu

(10) Patent No.: US 11,133,597 B2
(45) Date of Patent: Sep. 28, 2021

(54) ANTENNA ARRAY AND WIRELESS DEVICE

(71) Applicant: HUAWEI TECHNOLOGIES CO., LTD., Guangdong (CN)

(72) Inventor: Sheng Liu, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/847,923

(22) Filed: Apr. 14, 2020

(65) Prior Publication Data

US 2020/0328527 A1 Oct. 15, 2020

(30) Foreign Application Priority Data

Apr. 15, 2019 (CN) ..... 201910301375.4

(51) Int. Cl.

| | |
|---|---|
| ***H01Q 19/09*** | (2006.01) |
| ***H01Q 21/20*** | (2006.01) |
| ***H01Q 19/06*** | (2006.01) |
| ***H01Q 3/46*** | (2006.01) |
| ***H01Q 21/00*** | (2006.01) |

(52) U.S. Cl.

CPC ..... *H01Q 19/09* (2013.01); *H01Q 3/46* (2013.01); *H01Q 19/06* (2013.01); *H01Q 19/062* (2013.01); *H01Q 21/0025* (2013.01); *H01Q 21/20* (2013.01)

(58) Field of Classification Search

CPC ..... H01Q 19/09; H01Q 21/20; H01Q 3/30; H01Q 15/08; H01Q 19/062; H01Q 21/00; H01Q 19/06

See application file for complete search history.

(56) References Cited

U.S. PATENT DOCUMENTS

| | | | | |
|---|---|---|---|---|
| 4,333,082 | A | 6/1982 | Susman | |
| 5,154,973 | A * | 10/1992 | Imagawa | H01Q 15/08 428/325 |
| 5,781,163 | A * | 7/1998 | Ricardi | H01Q 15/08 343/754 |
| 5,821,908 | A | 10/1998 | Sreenivas | |
| 5,929,819 | A | 7/1999 | Grinberg | |
| 6,246,369 | B1 | 6/2001 | Brown et al. | |
| 7,348,934 | B2 * | 3/2008 | Kuroda | H01Q 1/42 343/911 L |
| 7,400,304 | B2 * | 7/2008 | Lewis | H01Q 1/282 343/753 |

(Continued)

FOREIGN PATENT DOCUMENTS

| | | | |
|---|---|---|---|
| CN | 1682402 | A | 10/2005 |
| CN | 2831462 | Y | 10/2006 |

(Continued)

OTHER PUBLICATIONS

A kind of production method and device of the vigorous lens array dual-mode antenna device of dragon (English) CN 108987926 A Published on Dec. 11, 2018 (Year: 2018).*

*Primary Examiner* — Vibol Tan

(57) ABSTRACT

An antenna array and a wireless device using the antenna array are disclosed. The antenna array includes a first antenna set and a first radio frequency lens set. The first antenna set includes a plurality of antennas, and the first radio frequency lens set includes a plurality of radio frequency lenses. The plurality of antennas and the plurality of radio frequency lenses are arranged according to rules. According to the rules, the first radio frequency lens set can be used to increase a phase difference between radio signals from antennas.

16 Claims, 11 Drawing Sheets

(56) References Cited

U.S. PATENT DOCUMENTS

| | | | | |
|---|---|---|---|---|
| 10,199,739 | B2 * | 2/2019 | Matitsine | H01Q 15/02 |
| 10,483,650 | B1 * | 11/2019 | Zimmerman | H01Q 21/061 |
| 10,553,947 | B2 * | 2/2020 | Scarborough | H01Q 3/46 |
| 10,714,836 | B1 * | 7/2020 | Karabacak | H01Q 15/04 |
| 2004/0263419 | A1 | 12/2004 | Henderson | |
| 2018/0131078 | A1 * | 5/2018 | Shooshtari | H01Q 21/0031 |
| 2018/0269576 | A1 * | 9/2018 | Scarborough | H01Q 1/288 |
| 2019/0051989 | A1 * | 2/2019 | Kim | H01Q 15/08 |

FOREIGN PATENT DOCUMENTS

| | | | | |
|---|---|---|---|---|
| CN | 101427422 | A | | 5/2009 |
| CN | 105552551 | A | | 5/2016 |
| CN | 106663876 | A | | 5/2017 |
| CN | 107196066 | A | | 9/2017 |
| CN | 108987926 | A | * | 12/2018 |
| CN | 109075456 | A | | 12/2018 |
| CN | 109390667 | A | | 2/2019 |
| CN | 110582892 | A | | 12/2019 |
| EP | 1085599 | A2 | | 3/2001 |
| EP | 3467939 | A1 | | 4/2019 |
| JP | 54065640 | U | | 8/1922 |
| JP | H09130137 | A | | 5/1997 |
| JP | H09181523 | A | | 7/1997 |
| JP | 2005094069 | A | | 4/2005 |
| JP | 2017212569 | A | | 11/2017 |
| JP | 2018157541 | A | | 10/2018 |
| KR | 101859867 | B1 | | 5/2018 |
| WO | 2018048520 | A1 | | 3/2018 |

* cited by examiner

ANTENNA ARRAY AND WIRELESS DEVICE

CROSS-REFERENCE TO RELATED APPLICATION

This application claims priority to Chinese Patent Application No. 201910301375.4, filed on Apr. 15, 2019, which is hereby incorporated by reference in its entirety.

TECHNICAL FIELD

This application relates to the communications field, and in particular, to an antenna array and a wireless device.

BACKGROUND

Multiple-input and multiple-output (English: multiple-input and multiple-output, MIMO) uses an antenna array to receive or send signals to improve a wireless communication capacity, and is a wireless transmission technology widely used in a wireless communications system such as a cellular mobile communications system or a wireless local area network (English: wireless local area network, WLAN). For example, a 4th generation (English: 4th Generation, 4G) mobile communications system referred to as long-term evolution (English: Long-Term Evolution, LTE), new radio (English: New Radio, NR) in a 5th generation (English: 5th Generation, 5G) mobile communications system, and a WLAN expand a system capacity by increasing a quantity of antennas. For example, there may be more than 64 antennas in LTE and NR, and there may be 16 antennas in the WLAN. According to an MIMO principle, a spacing between adjacent antennas in an MIMO antenna array needs to be at least 0.5λ Otherwise, radiation efficiency of the antenna is reduced, and therefore MIMO performance is deteriorated. Herein, λ is a free space wavelength of a radio frequency carrier. To obtain good MIMO performance, a spacing 0.7λ between adjacent antennas in an antenna array is usually used in an actual application. In addition to MIMO communication, the antenna array is widely applied to fields such as beamforming, estimation of beam arrival direction, beam tracking, and microwave imaging. These applications require that the spacing between the adjacent antennas needs to be at least 0.5λ. In addition, due to engineering limitations such as appearance, wind resistance, load bearing, and costs, a size of the antenna array cannot be too large. This conflicts with a requirement for a large quantity of antennas.

SUMMARY

This application provides an antenna array and a wireless device, to improve MIMO performance per unit size.

According to a first aspect, an antenna array is provided. The antenna array includes a first antenna set and a first radio frequency lens set. The first antenna set includes a plurality of antennas. The first radio frequency lens set includes a plurality of radio frequency lenses. The plurality of antennas in the first antenna set and the plurality of radio frequency lenses in the first radio frequency lens set are arranged according to rules. The rules include:

(1) The plurality of radio frequency lenses are in a one-to-one correspondence with the plurality of antennas, and each radio frequency lens is arranged on a corresponding antenna.

(2) Any one of the plurality of radio frequency lenses includes two or more parts whose wavefront phase adjustment amounts are different, and wavefront phase adjustment amounts of the plurality of radio frequency lenses in any direction of arrival (English: direction of arrival, DOA) meet the following conditions: A plurality of wavefront phase adjustment amounts of the plurality of radio frequency lenses in a direction of arrival are monotonically increasing along the direction; and at least two of the plurality of wavefront phase adjustment amounts of the plurality of radio frequency lenses in the direction of arrival are different.

Because the antennas and the radio frequency lenses in the antenna array are arranged according to the foregoing rules, the radio frequency lens increases or at least does not decrease an equivalent wave path difference between an electromagnetic wave that arrives at a farther antenna and an electromagnetic wave that arrives at a nearer antenna, to increase a phase difference between radio signals from the antennas. MIMO performance is related to a coupling between the radio signals from the antennas. A larger phase difference between the radio signals from the antennas indicates a lower coupling. Therefore, the antenna array has better MIMO performance per unit size.

In the rule (2) of the first aspect, the plurality of radio frequency lenses are in a one-to-one correspondence with the plurality of wavefront phase adjustment amounts of the plurality of radio frequency lenses in the direction of arrival. A wavefront phase adjustment amount of one of the plurality of radio frequency lenses in the direction of arrival is a wavefront phase adjustment amount of a part that is in all parts of the radio frequency lens and through which a corresponding path straight line passes. The corresponding path straight line is a straight line that is along the direction of arrival and that passes through an antenna corresponding to the radio frequency lens. An order of the plurality of wavefront phase adjustment amounts along the direction of arrival is an order of projections that are of a plurality of corresponding antennas on a reference straight line and that are arranged on the reference straight line along the direction. The reference straight line may be any straight line along the direction of arrival.

With reference to the first aspect, in a first implementation of the first aspect, the plurality of radio frequency lenses in the first radio frequency lens set are a plurality of dielectric lenses. Any one of the plurality of dielectric lenses includes two or more parts with different materials, and dielectric constants of the different materials are different. Wavefront phase adjustment amounts of two parts with a same thickness are related to dielectric constants of materials of the corresponding parts. A larger dielectric constant indicates a larger wavefront phase adjustment amount. Because a relative magnetic permeability of a magnetic material in a gigahertz frequency band is usually close to 1, it is a simple choice to make a radio frequency lens by using a high dielectric constant material in the gigahertz frequency band and a frequency band above gigahertz.

With reference to the first aspect or the first implementation of the first aspect, in a second implementation of the first aspect, the plurality of radio frequency lenses are a plurality of dielectric hemispheres. The plurality of antennas in the first antenna set are respectively located at sphere centers of corresponding dielectric hemispheres in the first radio frequency lens set. An incident electromagnetic wave is exactly perpendicular to a surface of the radio frequency lens by using a hemispherical dielectric lens, so that a propagation direction is not changed when refraction occurs.

With reference to the first implementation of the first aspect or the second implementation of the first aspect, in a third implementation of the first aspect, at least one part of at least one dielectric lens in the first radio frequency lens set includes an anti-reflection structure. The anti-reflection structure is on a surface of the part. A dielectric constant of a material of the anti-reflection structure is less than a dielectric constant of the part. A thickness of the anti-reflection structure is one quarter of a wavelength of an electromagnetic wave in the material of the anti-reflection structure. The electromagnetic wave is reflected when passing through an interface between materials with different refractive indexes. Therefore, to reduce reflection of the electromagnetic wave on a surface of the dielectric lens, the anti-reflection structure may be added to the dielectric lens. A principle of the anti-reflection structure is the same as that of applying an anti-reflection coating to a surface of an optical glass to improve light transmittance. Further, to minimize reflection of the electromagnetic wave, a refractive index of the material of the anti-reflection structure is a geometric average value of refractive indexes of two materials on two sides of the anti-reflection structure.

With reference to any one of the first implementation of the first aspect to the third implementation of the first aspect, in a fourth implementation of the first aspect, the at least one dielectric lens in the first radio frequency lens set includes a fusion structure. The fusion structure is between an antenna corresponding to the dielectric lens and an interface between parts of the dielectric lens. A dielectric constant of a material of the fusion structure is less than a smallest dielectric constant of materials of the parts of the dielectric lens. The electromagnetic wave is reflected when passing through an interface between materials with different refractive indexes. Therefore, to reduce reflection of the electromagnetic wave on the interface between the different materials in the dielectric lens, the fusion structure may be added to the dielectric lens. A surface of the fusion structure is bent, for example, in an arc shape, so that the electromagnetic wave passes through the surface at a large angle, to reduce reflection of the electromagnetic wave.

With reference to any one of the first aspect, or the first implementation of the first aspect to the fourth implementation of the first aspect, in a fifth implementation of the first aspect, the plurality of antennas in the first antenna set are patch antennas or on-chip antennas.

With reference to any one of the first implementation of the first aspect to the fifth implementation of the first aspect, in a sixth implementation of the first aspect, the plurality of antennas in the first antenna set are arranged in a column along a straight line, and each dielectric lens includes two parts that are with different materials but a same size. An interface between the two parts is perpendicular to the straight line. Dielectric constants of materials of all left parts in all pairs of the two parts of the plurality of dielectric lenses in the first radio frequency lens set are strictly monotonically increasing along the straight line from left to right. Dielectric constants of materials of all right parts in all pairs of the two parts of the plurality of dielectric lenses in the first radio frequency lens set are strictly monotonically decreasing along the straight line from left to right.

With reference to any one of the first aspect, or the first implementation of the first aspect to the sixth implementation of the first aspect, in a seventh implementation of the first aspect, the antenna array further includes a second antenna set and a second radio frequency lens set. The second antenna set includes a plurality of antennas. The second radio frequency lens set includes a plurality of radio frequency lenses. The plurality of antennas in the second antenna set and the plurality of radio frequency lenses in the second radio frequency lens set are arranged according to the rules. Polarization directions of the plurality of antennas in the first antenna set are the same. Polarization directions of the plurality of antennas in the second antenna set are the same. A polarization direction of any antenna in the first antenna set is orthogonal to a polarization direction of any antenna in the second antenna set.

According to a second aspect, an antenna array is provided. The antenna array includes eight antennas arranged on a plane and eight radio frequency lenses. The eight antennas are arranged in a regular octagon. The eight radio frequency lenses are in a one-to-one correspondence with the eight antennas. Each radio frequency lens is arranged on a corresponding antenna. Any one of the eight radio frequency lenses includes four areas with a same size. An angle of 45 degrees is formed between a first straight line along a front-to-rear direction and each of interfaces between the four areas in the any radio frequency lens, and an angle of 45 degrees is formed between a second straight line along a left-to-right direction and each of the interfaces between the four areas in the any radio frequency lens. Wavefront phase adjustment amounts of all front areas in all combinations of the four areas in all of the eight radio frequency lenses are strictly monotonically increasing along the first straight line from front to rear. Wavefront phase adjustment amounts of all rear areas in all combinations of the four areas in all of the eight radio frequency lenses are strictly monotonically decreasing along the first straight line from front to rear. Wavefront phase adjustment amounts of all left areas in all combinations of the four areas in all of the eight radio frequency lenses are strictly monotonically increasing along the second straight line from left to right. Wavefront phase adjustment amounts of all right areas in all combinations of the four areas in all of the eight radio frequency lenses are strictly monotonically decreasing along the second straight line from left to right.

With reference to the second aspect, in a first implementation of the second aspect, the eight radio frequency lenses are eight dielectric lenses. Adjacent areas with different wavefront phase adjustment amounts in the areas belong to different parts, materials of the different parts are different, and dielectric constants of the different materials are different. Wavefront phase adjustment amounts of two parts with a same thickness are related to dielectric constants of materials of the corresponding parts. A larger dielectric constant indicates a larger wavefront phase adjustment amount.

With reference to the second aspect or the first implementation of the second aspect, in a second implementation of the second aspect, the eight radio frequency lenses are eight dielectric hemispheres. The eight antennas are located at sphere centers of corresponding dielectric hemispheres.

With reference to the first implementation of the second aspect or the second implementation of the second aspect, in a third implementation of the second aspect, at least one part of at least one of the eight radio frequency lenses includes an anti-reflection structure. The anti-reflection structure is on a surface of the part. A dielectric constant of a material of the anti-reflection structure is less than a dielectric constant of the part. A thickness of the anti-reflection structure is one quarter of a wavelength of an electromagnetic wave in the material of the anti-reflection structure.

With reference to any one of the first implementation of the second aspect to the third implementation of the second aspect, in a fourth implementation of the second aspect, the at least one of the eight radio frequency lenses includes a fusion structure. The fusion structure is between an antenna corresponding to the radio frequency lens and an interface between parts of the radio frequency lens. A dielectric constant of a material of the fusion structure is less than a smallest dielectric constant of materials of the parts of the radio frequency lens.

With reference to any one of the second aspect, or the first implementation of the second aspect to the fourth implementation of the second aspect, in a fifth implementation of the second aspect, the eight antennas are patch antennas or on-chip antennas.

According to a third aspect, an antenna array is provided. The antenna array includes a plurality of antennas arranged on a plane and a plurality of radio frequency lenses. The plurality of antennas are arranged in a rectangle. The plurality of radio frequency lenses are in a one-to-one correspondence with the plurality of antennas. Each radio frequency lens is arranged on a corresponding antenna. Any one of the plurality of radio frequency lenses includes four areas with a same size. Interfaces between the four areas in the any radio frequency lens are perpendicular to the plane. Interfaces between the four areas in the any radio frequency lens are at least parallel to one side of the rectangle. Wavefront phase adjustment amounts of all left front areas in any row of radio frequency lenses in the plurality of radio frequency lenses are strictly monotonically increasing from left to right. Wavefront phase adjustment amounts of all left rear areas in any row of radio frequency lenses in the plurality of radio frequency lenses are strictly monotonically increasing from left to right. Wavefront phase adjustment amounts of all right front areas in any row of radio frequency lenses in the plurality of radio frequency lenses are strictly monotonically decreasing from left to right. Wavefront phase adjustment amounts of all right rear areas in any row of radio frequency lenses in the plurality of radio frequency lenses are strictly monotonically decreasing from left to right. Wavefront phase adjustment amounts of all left front areas in any column of radio frequency lenses in the plurality of radio frequency lenses are strictly monotonically increasing from front to rear. Wavefront phase adjustment amounts of all left rear areas in any column of radio frequency lenses in the plurality of radio frequency lenses are strictly monotonically decreasing from front to rear. Wavefront phase adjustment amounts of all right front areas in any column of radio frequency lenses in the plurality of radio frequency lenses are strictly monotonically increasing from front to rear. Wavefront phase adjustment amounts of all right rear areas in any column of radio frequency lenses in the plurality of radio frequency lenses are strictly monotonically decreasing from front to rear.

With reference to the third aspect, in a first implementation of the third aspect, the plurality of radio frequency lenses are a plurality of dielectric lenses. Adjacent areas with different wavefront phase adjustment amounts in the areas belong to different parts, materials of the different parts are different, and dielectric constants of the different materials are different. Wavefront phase adjustment amounts of two parts with a same thickness are related to dielectric constants of materials of the corresponding parts. A larger dielectric constant indicates a larger wavefront phase adjustment amount.

With reference to the third aspect or the first implementation of the third aspect, in a second implementation of the third aspect, the plurality of radio frequency lenses are a plurality of dielectric hemispheres. The plurality of antennas are located at sphere centers of corresponding dielectric hemispheres.

With reference to the first implementation of the third aspect or the second implementation of the third aspect, in a third implementation of the third aspect, at least one part of at least one of the plurality of radio frequency lenses includes an anti-reflection structure. The anti-reflection structure is on a surface of the part. A dielectric constant of a material of the anti-reflection structure is less than a dielectric constant of the part. A thickness of the anti-reflection structure is one quarter of a wavelength of an electromagnetic wave in the material of the anti-reflection structure.

With reference to any one of the first implementation of the third aspect to the third implementation of the third aspect, in a fourth implementation of the third aspect, the at least one of the plurality of radio frequency lenses includes a fusion structure. The fusion structure is between an antenna corresponding to the radio frequency lens and an interface between parts of the radio frequency lens. A dielectric constant of a material of the fusion structure is less than a smallest dielectric constant of materials of the parts of the radio frequency lens.

With reference to any one of the third aspect, or the first implementation of the third aspect to the fourth implementation of the third aspect, in a fifth implementation of the third aspect, the plurality of antennas are patch antennas or on-chip antennas.

According to a fourth aspect, a wireless device is provided. The wireless device includes the antenna array according to the first aspect, the second aspect, the third aspect, or any implementation of any one of the foregoing aspects. The wireless device further includes a radio frequency circuit connected to the antenna array. The radio frequency circuit is configured to: receive or send signals by using the antenna array.

With reference to the fourth aspect, in a first implementation of the fourth aspect, the radio frequency circuit is configured to: receive or send the signals by using the antenna array in a multiple-input multiple-output manner.

DESCRIPTION OF EMBODIMENTS

The following describes the embodiments of the present invention with reference to FIG. 1 to FIG. 18.

Figure 1:
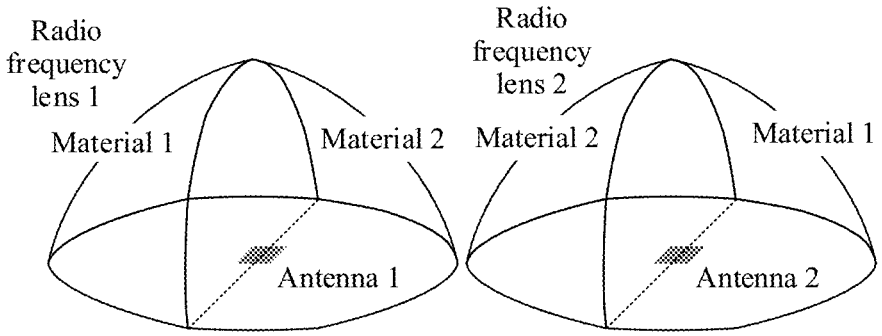
FIG. 1 is a structural diagram of an example of an antenna array according to an embodiment of the present invention.
Figure 2:
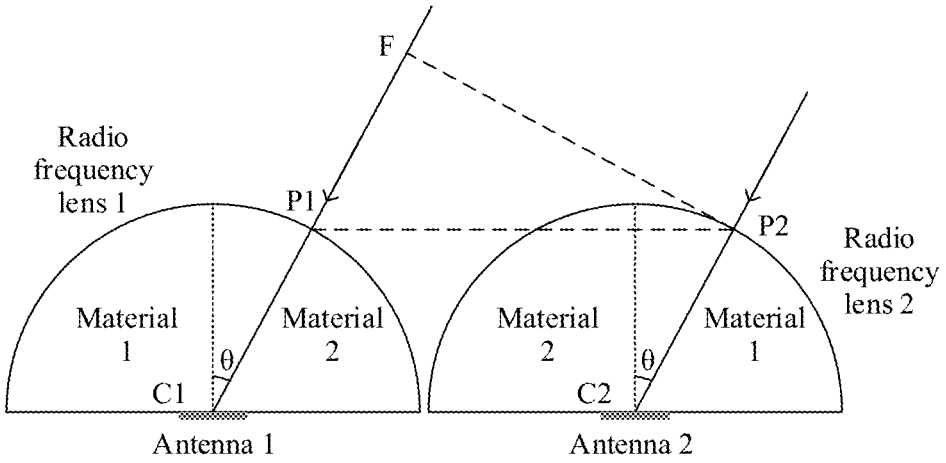
FIG. 2 is a conceptual diagram according to an embodiment of the present invention.

FIG. 1 is a structural diagram of an example of an antenna array according to an embodiment of the present invention. FIG. 2 is a conceptual diagram according to an embodiment of the present invention.

MIMO performance is greatly affected by a correlation between MIMO channels. A stronger correlation between the MIMO channels indicates poorer MIMO performance. In a same radio channel condition, the correlation between the MIMO channels is related to a phase difference between radio signals from antennas. Usually, a smaller spacing between adjacent antennas indicates a smaller phase difference between radio signals from antennas and a stronger correlation between MIMO channels. To improve MIMO performance of an antenna array per unit size, in this embodiment of the present invention, a radio frequency lens is used to increase the phase difference between the radio signals from the antennas. Each radio frequency lens covers or wraps a corresponding antenna.

In this embodiment of the present invention, the antenna in the antenna array may be a patch antenna on a printed circuit board or another carrier. For example, a patch antenna on a chip using a semiconductor process, namely, an on-chip antenna (English: on-chip antenna), is used as the antenna in the antenna array. The antenna in the antenna array may alternatively be another flat antenna.

In this embodiment of the present invention, the antenna array may be arranged on a plane. The antenna array may alternatively be arranged on a non-plane. For example, the antenna array is arranged on a curved surface, or arranged on a step-shaped bottom plate. An arrangement of the antenna array may be higher in the middle and lower in the surroundings.

The radio frequency lens is a device that can change a wavefront phase obtained when a radio signal arrives at an antenna. For example, the radio frequency lens or a part of the radio frequency lens may be made of a dielectric, and a refractive index of the dielectric is higher than a refractive index of air. In other words, the radio frequency lens may be made of a material whose dielectric constant or magnetic permeability is different from that of air. Because dielectric constants or magnetic permeabilities of different materials may vary with a frequency of the radio signal, a material of which the radio frequency lens is made may be selected based on an applicable frequency of the antenna array. For example, because a relative magnetic permeability of a magnetic material in a gigahertz (GHz) frequency band is usually close to 1, it is a better choice to make the radio frequency lens by using a high dielectric constant material in the GHz frequency band and a frequency band above GHz.

Because a wavelength of an electromagnetic wave in a dielectric is less than a wavelength of the electromagnetic wave in free space, after a same distance, a wavefront phase of the electromagnetic wave in the dielectric changes more greatly than a wavefront phase of the electromagnetic wave in the free space. In addition to a dielectric lens, any device that can change a wavefront phase of the electromagnetic wave may serve as the radio frequency lens. For example, the radio frequency lens or a part of the radio frequency lens may be made of an artificial dielectric (English: artificial dielectric) material or another metamaterial, to provide a variable wavefront phase adjustment amount. An artificial dielectric is a type of artificial dielectric that meets a specific requirement and that is formed by artificially doping, into the dielectric to change an electromagnetic characteristic of the dielectric, structures such as particles, wires, or sheets of another material (for example, a metal) that have a sub-wavelength size and that are regularly arranged. For example, an effective dielectric constant of the artificial dielectric may be added.

Materials with a same thickness but different dielectric constants or magnetic permeabilities have different wavefront phase adjustment amounts. As shown in FIG. 1, a radio frequency lens corresponding to each antenna in the antenna array includes parts with different wavefront phase adjustment amounts. Radio signals from a specific direction pass through different materials before arriving at different antennas, so that wavefront phases obtained when the radio signals arrive at the different antennas are different, to increase a phase difference between radio signals from antennas. FIG. 1 shows a simple example of the antenna array according to this embodiment of the present invention. The antenna array includes two antennas and two corresponding radio frequency lenses. The two radio frequency lenses are both hemispherical, and have a same radius. A radius of the radio frequency lens is r. An antenna 1 corresponds to a radio frequency lens 1. An antenna 2 corresponds to a radio frequency lens 2. Each radio frequency lens includes two parts. An interface between the two parts is perpendicular to a straight line that passes through the two antennas. A part that is of each radio frequency lens and that is located on an outer side of the antenna array is made of a material 1, and a part that is of each radio frequency lens and that is located on an inner side of the antenna array is made of a material 2. A dielectric constant (namely, a relative permittivity) of the material 1 is $\varepsilon_{r1}$, and a dielectric constant of the material 2 is $\varepsilon_{r2}$. Herein, $\varepsilon_{r1}<\varepsilon_{r2}$.

FIG. 2 is a cross section view of the antenna array shown in FIG. 1, to show a principle of this embodiment of the present invention. As shown in FIG. 2, electromagnetic waves whose incident angles are θ are represented by two parallel rays. An electromagnetic wave arriving at the antenna 1 is emitted into a part made of the material 2 of the radio frequency lens 1 at a point P1. An electromagnetic wave arriving at the antenna 2 is emitted into a part made of the material 1 of the radio frequency lens 2 at a point P2. In free space (air), a wave path difference between the electromagnetic wave arriving at the antenna 1 and the electromagnetic wave arriving at the antenna 2 is a length P1F. P1F refers to a line segment between the point P1 and a point F. The point F is a foot of a perpendicular from P2 to C1P1. C1P1 refers to a line segment between a point C1 and the point P1. Regardless of whether a radio frequency lens is introduced into the antenna array, there is at least a wave path difference P1F between the electromagnetic wave arriving at the antenna 1 and the electromagnetic wave arriving at the antenna 2. After the radio frequency lens in this embodiment of the present invention is introduced, because the electromagnetic wave arriving at the antenna 1 arrives at C1 through C1P1 starting from P1, the electromagnetic wave passes through the material 2 whose length is r. An equivalent wave path of the electromagnetic wave that passes through the material 2 whose length is r is $n_2$r. The equivalent wave path of the electromagnetic wave is a wave path through which the electromagnetic wave passes in free space when a wavefront phase change amount of the electromagnetic wave during propagation in the free space is the same as a wavefront phase change amount of the electromagnetic wave during propagation in a dielectric. Herein, $n_2$ is a refractive index of the material 2 for the electromagnetic wave, and $n_2=(\varepsilon_{r2}\mu_{r2})^{1/2}$. Herein, $\mu_{r2}$ is a relative magnetic permeability of the material 2 for the electromagnetic wave. If $\mu_{r2}$ is 1, $n_2=\varepsilon_{r2}^{1/2}$. An equivalent wave path of the electromagnetic wave that passes through the material 2 whose length is r is $\varepsilon_{r2}^{1/2}$r. Similarly, because the electromagnetic wave arriving at the antenna 2 arrives at C2 through C2P2 starting from P2, the electromagnetic wave passes through the material 1 whose length is r. An equivalent wave path of the electromagnetic wave that passes through the material 1 whose length is r is $n_1$r, where $n_1$ is a refractive index of the material 1 for the electromagnetic wave, and $n_1=(\varepsilon_{r1}\mu_{r1})^{1/2}$. Herein, $\mu_{r1}$ is a relative magnetic permeability of the material 1 for the electromagnetic wave. If $\mu_{r1}$ is 1, $n_1=\varepsilon_{r1}^{1/2}$. An equivalent wave path of the electromagnetic wave that passes through the material 1 whose length is r is $\varepsilon_{r1}^{1/2}$r. A wave path difference δ between the electromagnetic wave arriving at the antenna 1 and the electromagnetic wave arriving at the antenna 2 is P1F+$(\varepsilon_{r2}^{1/2}-\varepsilon_{r1}^{1/2})$r. Because $\varepsilon_{r1}<\varepsilon_{r2}$, P1F+$(\varepsilon_{r2}^{1/2}-\varepsilon_{r1}^{1/2})$r>P1F. It can be learned that after the radio frequency lens in this embodiment of the present invention is introduced, a wave path difference between an equivalent wave path of the electromagnetic wave arriving at the antenna 1 and an equivalent wave path of the electromagnetic wave arriving at the antenna 2 increases. Correspondingly, a phase difference between radio signals from antennas increases.

Because the radio frequency lens in this embodiment of the present invention can be introduced to increase the phase difference between the radio signals from the antennas, MIMO performance of the antenna array can be improved without changing a size of the antenna array. In addition, while it is ensured that MIMO performance of the antenna array is not reduced, the radio frequency lens in this embodiment of the present invention can be introduced to reduce the size of the antenna array.

The antenna array shown in FIG. 1 and FIG. 2 is used as an example. If the radio frequency lens 1 is close to the radio frequency lens 2, and $\theta=\pi/6$, the length P1F is $2r>\sin(\pi/6)=r$, and $\delta$=P1F+$(\varepsilon_{r2}^{1/2}-\varepsilon_{r1}^{1/2}$r=$(1+\varepsilon_{r2}^{1/2}-\varepsilon_{r1}^{1/2})$r. If the antenna array needs to achieve equivalent MIMO performance of an antenna array with a distance 0.5λ between antennas without the radio frequency lens, δ needs to be greater than or equal to $\delta_0$, where $\delta_0$ is an equivalent wave path difference between antennas in the antenna array that has the distance 0.5λ, between the antennas without the radio frequency lens and in which radio signals with $\theta=\pi/6$ are propagated, and $\delta_0=0.5\lambda\times\sin(\pi/6)=0.25$. Therefore, $r=\lambda/4(1+\varepsilon_{r2}^{1/2}-\varepsilon_{r1}^{1/2})$. If $\varepsilon_{r1}=4$, $\varepsilon_{r2}=9$, and $r=\lambda/8$, after the radio frequency lens in this embodiment of the present invention is introduced, a distance between antennas may be reduced to 0.25λ, and is a half of the distance between the antennas without the radio frequency lens.

FIG. 1 and FIG. 2 show only a simple implementation of this embodiment of the present invention. A more complex antenna array may be implemented according to the principle of this embodiment of the present invention.

For example, in the foregoing embodiment, because a surface of the radio frequency lens is a spherical surface, the antenna is located at a sphere center, and an incident electromagnetic wave is exactly perpendicular to the surface of the radio frequency lens, a propagation direction is not changed when refraction occurs. In some specific implementations of this embodiment of the present invention, a radio frequency lens with a spherical surface may not be used. For example, a polyhedron surface similar to the spherical surface is used to reduce processing difficulty of the radio frequency lens. For another example, because an electromagnetic wave that is incident in an approximately horizontal direction is blocked by another radio frequency lens, a shape of a radio frequency lens that is close to a horizontal plane part may be designed based on a propagation characteristic of the electromagnetic wave, for example, a cylindrical surface, to obtain a radio frequency lens whose upper part has a hemispherical surface and whose lower part has a surface in another shape. For another example, a radio frequency lens that conforms to a characteristic of a directivity pattern of a directional antenna may be designed for the directional antenna, for example, a radio frequency lens with an ellipsoidal surface.

For another example, in the foregoing embodiment, because the antenna array is used to receive or send only radio signals above the floor, the radio frequency lens is hemispherical. If a working direction of the antenna array is not an upper half part of space, a radio frequency lens with a corresponding shape such as a spherical shape, a quarter-spherical shape, or an eighth-spherical shape may be used.

For another example, the antenna array may include more than two antennas and radio frequency lenses. In this embodiment of the present invention, a quantity "two or more" is collectively referred to as "a plurality of". Therefore, a case of two antennas and radio frequency lenses is considered. In this case, the antenna array in this embodiment of the present invention includes a plurality of antennas and a plurality of corresponding radio frequency lenses. These antennas and radio frequency lenses are arranged according to rules in this embodiment of the present invention. For another example, the antenna array may include two or more independent antenna sets, and each antenna set has a corresponding radio frequency lens set. Each radio frequency lens set is arranged according to the foregoing rules. Different antenna sets each include a plurality of antennas in a different polarization direction. Polarization directions of all antennas in each antenna set are the same. Polarization directions of different antenna sets are orthogonal. The polarization directions of the different antenna sets are orthogonal, and there is no coupling between radio signals in the different antenna sets. Therefore, the different antenna sets may be independently arranged according to the foregoing rules.

To improve MIMO performance of the antenna array per unit size, the rules in this embodiment of the present invention need to meet at least the following conditions:

(1) Each antenna needs to have a corresponding radio frequency lens. The corresponding radio frequency lens is arranged on a corresponding antenna.

(2) In radio signals that are incident from a same direction, an equivalent wave path of an electromagnetic wave that arrives at a farther antenna is longer than that of an electromagnetic wave that arrives at a nearer antenna. To increase or at least not decrease an equivalent wave path difference, each radio frequency lens includes two or more parts with different wavefront phase adjustment amounts, so that in the radio signals that are incident from the same direction, an equivalent wave path added by a corresponding radio frequency lens to the electromagnetic wave that arrives at the farther antenna needs to be longer than or equal to that added by the corresponding radio frequency lens to the electromagnetic wave that arrives at the nearer antenna. The farther or nearer antenna is an antenna farther or nearer to a signal source of the radio signal in the incident direction. In the foregoing description, a relationship between the equivalent wave paths of the electromagnetic waves is described from a direction in which the electromagnetic waves arrive at the antennas. Based on symmetry, if observation is performed from a direction in which the electromagnetic waves leave the antennas, the equivalent wave paths of the electromagnetic waves have a same relationship. To achieve the foregoing objective, wavefront phase adjustment amounts of all parts of the radio frequency lens are arranged in the following method.

A plurality of wavefront phase adjustment amounts of a plurality of radio frequency lenses in any direction are monotonically increasing along the corresponding direction. A wavefront phase adjustment amount of each radio frequency lens in the direction is a wavefront phase adjustment amount of a part that is in all parts of the radio frequency lens and through which an electromagnetic wave arriving at a corresponding antenna (namely, an antenna covered by the radio frequency lens) passes.

The wavefront phase adjustment amounts are monotonically increasing along a corresponding direction, that is, monotonically increasing along a direction from a signal source of a radio signal to an antenna. To be specific, if a plurality of antennas are projected onto a direction of arrival of the radio signal (in other words, projected onto a reference straight line, where the reference straight line is any straight line parallel to the direction of arrival), wavefront phase adjustment amounts of corresponding radio frequency lenses in the direction from the signal source of the radio signal to the antenna are monotonically increasing in an order of projections arranged along the direction.

(3) If an equivalent wave path difference between electromagnetic waves of all antennas is only not decreased, MIMO performance of the antenna array per unit size cannot be improved. To improve MIMO performance of the antenna array per unit size, a wave path difference between electromagnetic waves of at least two antennas needs to be increased. Therefore, radio frequency lenses corresponding to the at least two antennas in one direction have different wavefront phase adjustment amounts in the direction. Because the condition (2) already requires that the wavefront phase adjustment amounts of the two radio frequency lenses in the direction are monotonically increasing along the direction, the different wavefront phase adjustment amounts indicate that the wavefront phase adjustment amounts of the two radio frequency lenses in the direction are strictly increasing along the direction.

Figure 3:
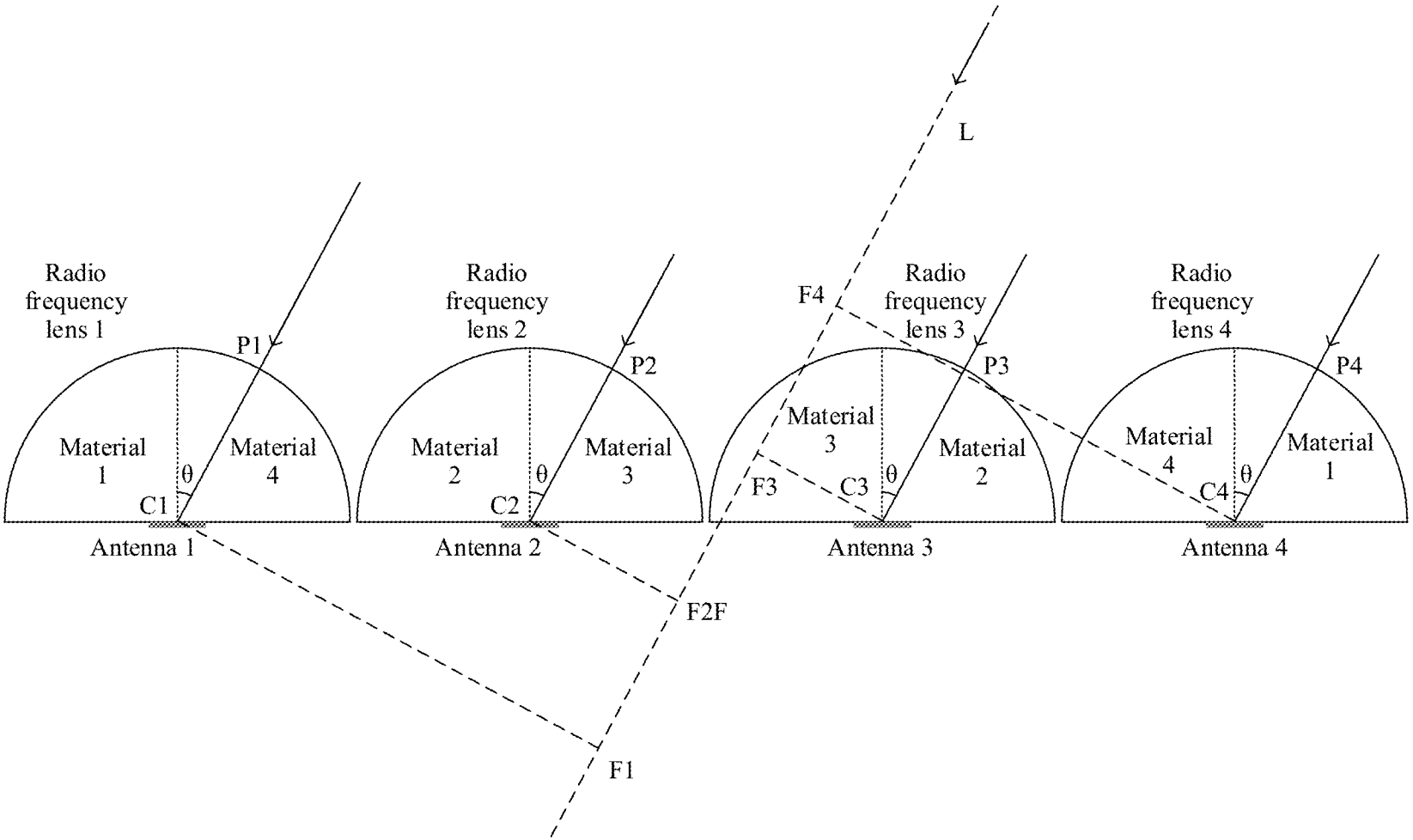
FIG. 3 is a schematic diagram of an image obtained by projecting a plurality of antennas onto a direction of arrival of a radio signal according to an embodiment of the present invention.

FIG. 3 is a schematic diagram of describing an image obtained by projecting a plurality of antennas onto a direction of arrival of a radio signal. An antenna array in FIG. 3 includes four antennas and corresponding radio frequency lenses. The antenna array in FIG. 3 is arranged in a linear manner. A projection of the antenna may be represented by a projection of a center of the antenna. Centers of an antenna 1 to an antenna 4 are sequentially C1 to C4. Projections of C1 to C4 in the direction of arrival of the radio signal are sequentially F1 to F4. A reference straight line shown in FIG. 3 is a dashed line L parallel to the direction of arrival. Projections are arranged along a direction from a signal source of the radio signal to the antenna in the following order: the antenna 4, the antenna 3, the antenna 2, and the antenna 1. Wavefront phase adjustment amounts of corresponding radio frequency lenses in the direction are sequentially a wavefront phase adjustment amount of a material 1, a wavefront phase adjustment amount of a material 2, a wavefront phase adjustment amount of a material 3, and a wavefront phase adjustment amount of a material 4. If the wavefront phase adjustment amount of the material 1, the wavefront phase adjustment amount of the material 2, the wavefront phase adjustment amount of the material 3, and the wavefront phase adjustment amount of the material 4 are respectively M1, M2, M3, and M4, a condition that M1<=M2<=M3<=M4 needs to be met, and values of at least two of M1, M2, M3, and M4 are not equal. For example, M1<M2<M3<M4.

In a homogeneous material, a change of a wavefront phase is proportional to a refractive index multiplied by a wave path and then divided by a wavelength. A wavefront phase adjustment amount of a dielectric lens in a direction may be considered as a sum of wavefront phase adjustment amounts of materials on a path through which an electromagnetic wave that is incident along the direction passes. The dielectric lens may include a plurality of layers of materials in the direction. The materials may be homogeneous, or may have gradient dielectric constants and/or magnetic permeabilities. (If the dielectric constant and/or the magnetic permeability abruptly change/changes, a part in which the dielectric constant and/or the magnetic permeability abruptly change/changes may be used as an interface between different materials on two sides.) Without considering a complex characteristic of propagation of the electromagnetic wave in the material, a wavefront phase adjustment amount in a direction may be approximately used as a metric M based on the refractive index. M is calculated according to the following formula:

$$M=2\pi/\lambda\cdot\int_P^C n(x)dx$$

In the formula, P is an incident point of the electromagnetic wave on a surface of the dielectric lens; C is a point at which the electromagnetic wave arrives at the antenna; x is a point on a path through which the electromagnetic wave passes in the dielectric lens; and n(x) is a refractive index of the dielectric lens at the point x.

A homogeneous material is used as an example, and $M=2\pi nr/\lambda$. Herein, n is a refractive index of a material of a dielectric lens in a direction, and r is a radius of the dielectric lens.

Figure 4:
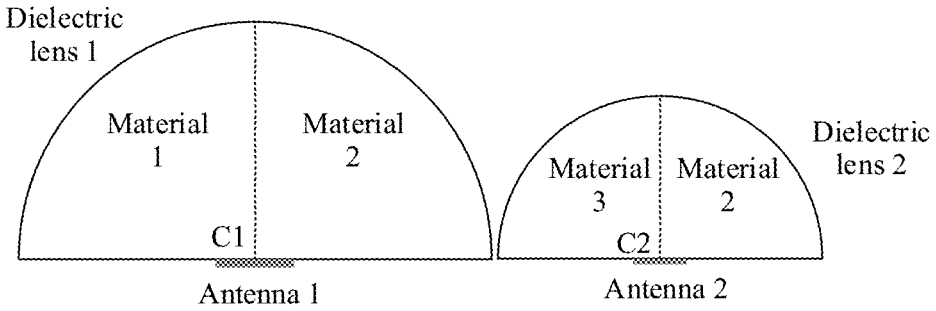
FIG. 4 shows another example of an antenna array according to an embodiment of the present invention.

For example, for details, refer to FIG. 4. FIG. 4 shows another example of an antenna array according to an embodiment of the present invention. As shown in FIG. 4, the antenna array includes two antennas and two corresponding dielectric lenses. The two dielectric lenses are both hemispherical, but have different radiuses. A radius of a dielectric lens 1 is $r_1$. A radius of a dielectric lens 2 is $r_2$. Herein, $r_1>r_2$. Each dielectric lens is divided into two parts. An interface between the two parts is perpendicular to a straight line that passes through the two antennas. A left half part of the dielectric lens 1 is made of a material 1. A left half part of the dielectric lens 2 is made of a material 3. Right half parts of the dielectric lens 1 and the dielectric lens 2 each are made of a material 2. A dielectric constant of the material 1 is $\varepsilon_{r1}$. A dielectric constant of the material 2 is $\varepsilon_{r2}$. A dielectric constant of the material 3 is $\varepsilon_{r3}$.

Herein, $\varepsilon_{r1}<\varepsilon_{r2}<\varepsilon_{r3}$.

In addition, a wavefront phase adjustment amount $M_{1L}$ of the left half part of the dielectric lens 1 is equal to $n_1r_1$. A wavefront phase adjustment amount $M_{1R}$ of the right half part of the dielectric lens 1 is equal to $n_2r_1$. A wavefront phase adjustment amount $M_{2L}$ of the left half part of the dielectric lens 2 is equal to $n_3r_2$. A wavefront phase adjustment amount $M_{2R}$ of the right half part of the dielectric lens 2 is equal to $n_1r_2$. Herein, $n_1=\varepsilon_{r1}^{1/2}$; $n_2=\varepsilon_{r2}^{1/2}$; and $n_3=\varepsilon_{r3}^{1/2}$. Because $r_1>r_2$, $M_{1R}>M_{2R}$. In addition, the dielectric constant of the material 3 needs to be large enough, so that $M_{1L}<M_{2L}$, in other words, $\varepsilon_{r1}^{1/2}r_1<\varepsilon_{r2}^{1/2}r_2$.

Because a wavefront phase adjustment amount of a radio frequency lens in a direction is related to a structure, a material, and a size that are of the radio frequency lens, a plurality of different radio frequency lenses may be designed. In terms of the size of the radio frequency lens, adjacent radio frequency lenses may be closely adhered to each other, and there may alternatively be a large or small distance between the adjacent radio frequency lenses.

Figure 5:
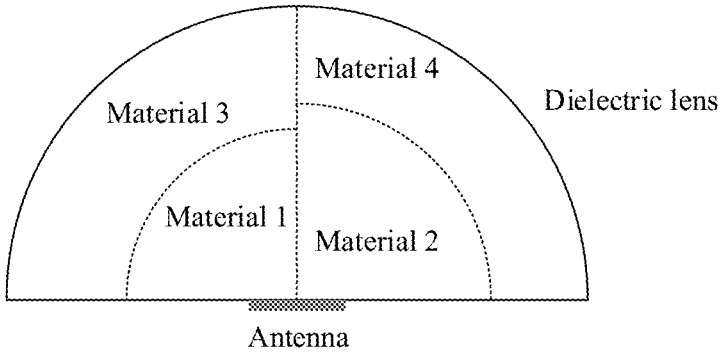
FIG. 5 is a structural diagram of a dielectric lens including an anti-reflection structure according to an embodiment of the present invention.

An electromagnetic wave is reflected when passing through an interface between materials with different refractive indexes. Therefore, to reduce reflection of the electromagnetic wave on a surface of the dielectric lens, an anti-reflection structure may be added to the dielectric lens. The anti-reflection structure is on a surface of each part of the dielectric lens. A refractive index of a material of the anti-reflection structure is less than a refractive index of a corresponding part. A thickness of the anti-reflection structure is one quarter of a wavelength of an electromagnetic wave in the anti-reflection structure. A principle of the anti-reflection structure is the same as that of applying an anti-reflection coating (English: anti-reflection coating) to a surface of an optical glass to improve light transmittance. FIG. 5 is a structural diagram of a dielectric lens including an anti-reflection structure. A refractive index $n_3$ of a material 3 is less than a refractive index $n_1$ of a material 1, and a refractive index $n_4$ of a material 4 is less than a refractive index $n_2$ of a material 2. A thickness of an anti-reflection structure made of the material 3 is one quarter of a wavelength of an electromagnetic wave in the anti-reflection structure. A thickness of an anti-reflection structure made of the material 4 is one quarter of a wavelength of an electromagnetic wave in the anti-reflection structure. To minimize reflection of the electromagnetic wave, a refractive index of the material of the anti-reflection structure needs to be a geometric average value of refractive indexes of two materials on two sides of the anti-reflection structure. Because the anti-reflection structure is on a surface of the dielectric lens, space outside the anti-reflection structure is free space, and a refractive index is approximately 1, the refractive index of the material of the anti-reflection structure needs to be a square root of a refractive index of a material on an inner side of the anti-reflection structure. For example, to minimize reflection of an electromagnetic wave in a left half part of the dielectric lens in FIG. 5, $n_3$ may be equal to $(n_1)^{1/2}$. To minimize reflection of an electromagnetic wave in a right half part of the dielectric lens in FIG. 5, $n_4$ may be equal to $(n_2)^{1/2}$.

Figure 6:
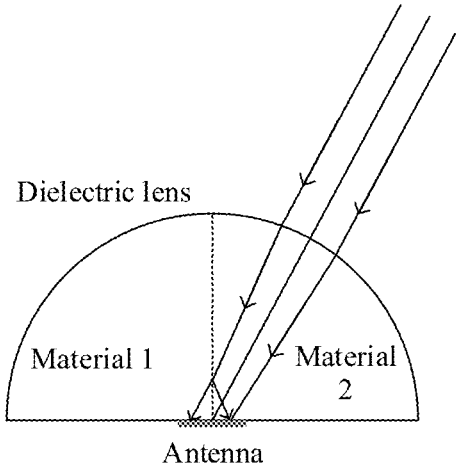
FIG. 6 is a schematic diagram in which an electromagnetic wave is reflected when passing through an interface between materials with different refractive indexes according to an embodiment of the present invention.
Figure 7:
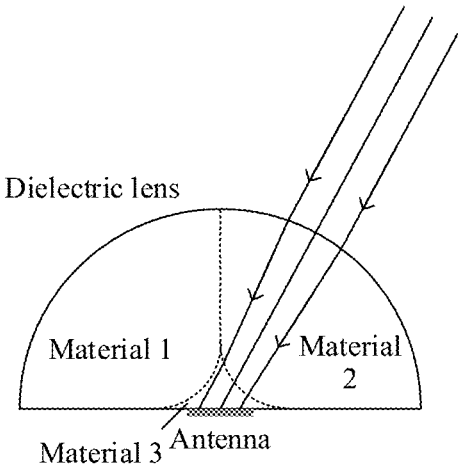
FIG. 7 is a structural diagram of a dielectric lens obtained after a fusion structure is added according to an embodiment of the present invention.

An electromagnetic wave is reflected when passing through an interface between materials with different refractive indexes. Therefore, to reduce reflection of the electromagnetic wave on the interface between the different materials in the dielectric lens, a fusion structure may be added to the dielectric lens. As shown in FIG. 6, a part of an electromagnetic wave may be reflected by an interface between materials. The dielectric lens to which the fusion structure is added is shown in FIG. 7, so that reflection of the electromagnetic wave on the interface between the materials can be reduced. As shown in FIG. 7, the fusion structure is between an antenna and an interface between parts of the dielectric lens. A refractive index of a material of the fusion structure is less than a refractive index of each part connected to the fusion structure. For example, the fusion structure may be a cavity. To be specific, a refractive index of the fusion structure is approximately 1. A surface of the fusion structure is bent, for example, in an arc shape, so that the electromagnetic wave passes through the surface at a large angle, to reduce reflection of the electromagnetic wave.

The foregoing shows the example of the linear antenna array in the embodiments of the present invention, but the antenna array in the embodiments of the present invention may be arranged in various manners. For example, the antenna array may be in a linear, parallelogram, rhombus, rectangle, circle, triangle, hexagon, trapezoid, or any other type of tessellation (English: tessellation) mode. The following provides some examples of arrangements of the antenna array. In these examples, top views are used to show the arrangements of the antenna array and wavefront phase adjustment amounts of parts of radio frequency lenses. A larger value of a part indicates a larger wavefront phase adjustment amount of the part. Regardless of how the antenna array is arranged, antennas and radio frequency lenses in the antenna array are arranged according to the foregoing rules.

Figure 8:
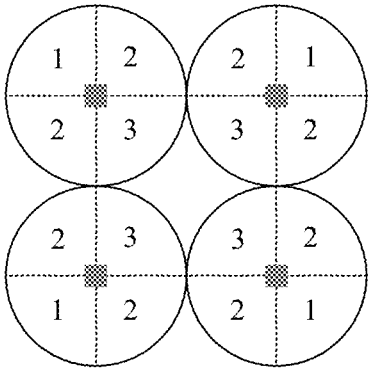
FIG. 8 shows an example 1 of an antenna array arranged as a rectangle according to an embodiment of the present invention.

FIG. 8 shows an example 1 of an antenna array arranged as a rectangle according to an embodiment of the present invention. The antenna array includes four antennas and four radio frequency lenses. Each radio frequency lens is divided into four parts. Wavefront phase adjustment amounts of the parts are arranged as shown in the figure.

Figure 9:
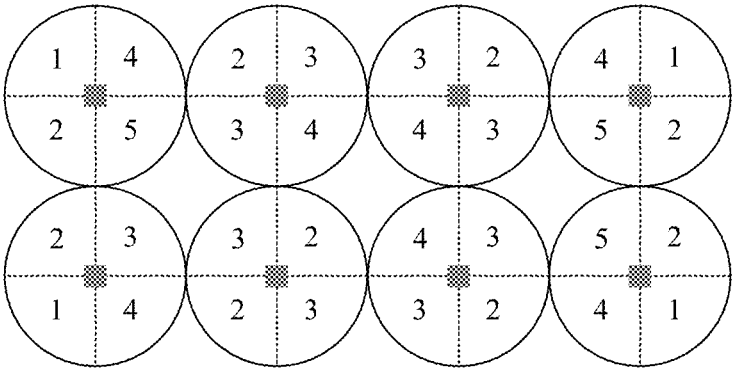
FIG. 9 shows an example 2 of an antenna array arranged as a rectangle according to an embodiment of the present invention.

FIG. 9 shows an example 2 of an antenna array arranged as a rectangle according to an embodiment of the present invention. The antenna array includes eight antennas and eight radio frequency lenses. Each radio frequency lens is divided into four parts. Wavefront phase adjustment amounts of the parts are arranged as shown in the figure.

Figure 10:
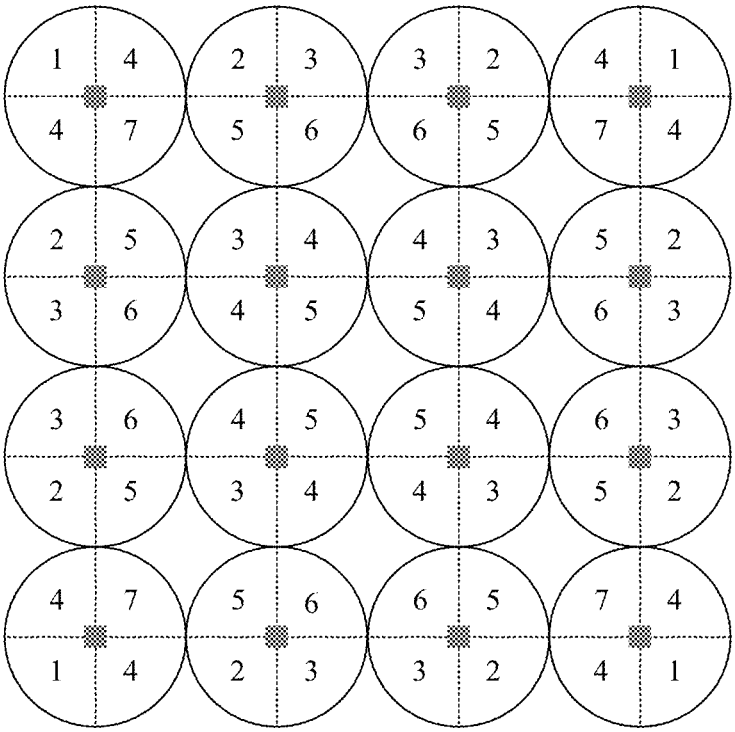
FIG. 10 shows an example 3 of an antenna array arranged as a rectangle according to an embodiment of the present invention.

FIG. 10 shows an example 3 of an antenna array arranged as a rectangle according to an embodiment of the present invention. The antenna array includes 16 antennas and 16 radio frequency lenses. Each radio frequency lens is divided into four parts. Wavefront phase adjustment amounts of the parts are arranged as shown in the figure.

Figure 11:
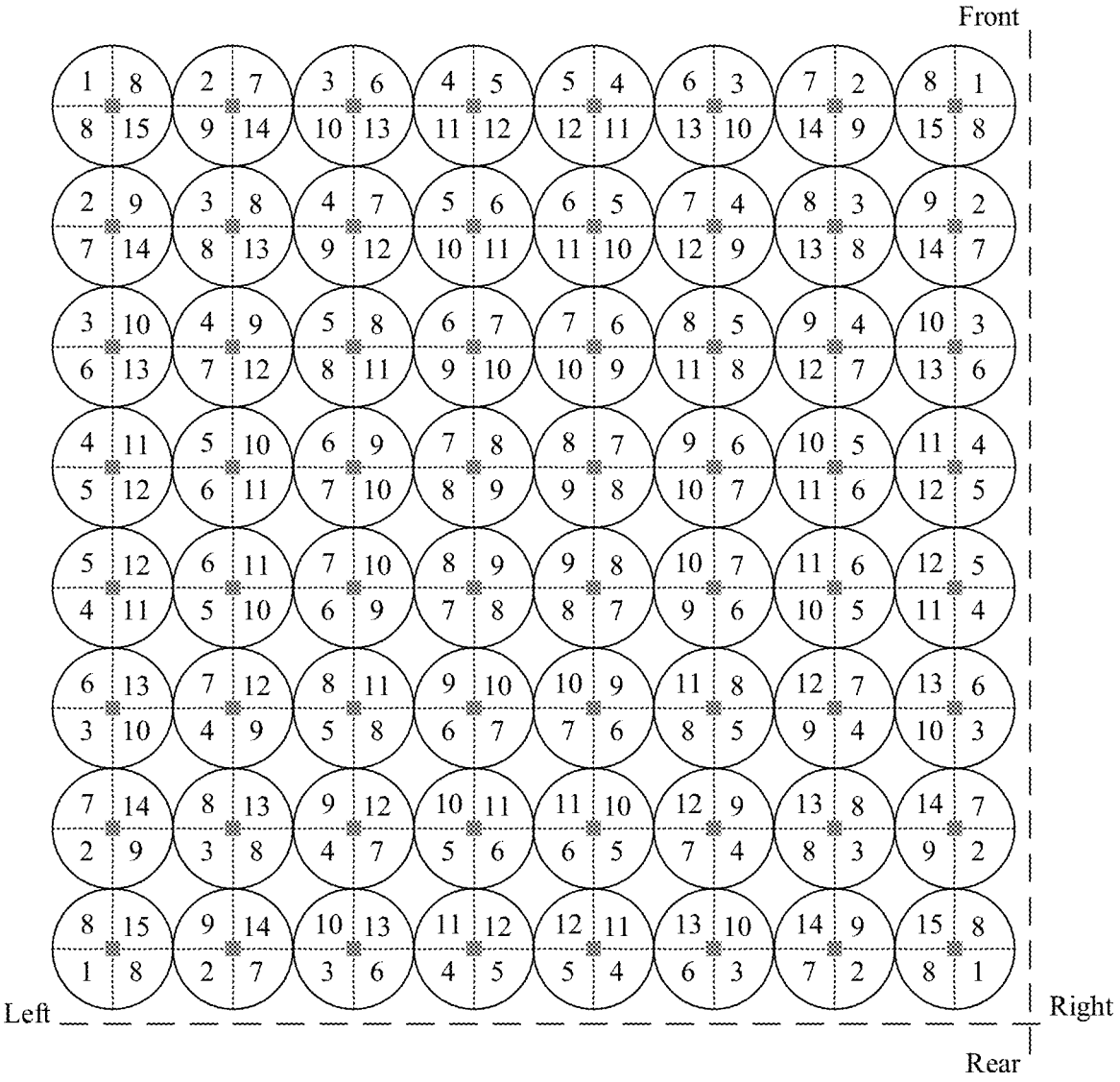
FIG. 11 shows an example 4 of an antenna array arranged as a rectangle according to an embodiment of the present invention.

FIG. 11 shows an example 4 of an antenna array arranged as a rectangle according to an embodiment of the present invention. The antenna array includes 64 antennas and 64 radio frequency lenses. Each radio frequency lens is divided into four parts. Wavefront phase adjustment amounts of the parts are arranged as shown in the figure.

An arrangement rule of the antenna array that is arranged as the rectangle and that is shown in FIG. 8 to FIG. 11 may be summarized as follows: The antenna array is arranged on a plane. Any one of a plurality of radio frequency lenses includes four areas with a same size. Interfaces between the four areas are perpendicular to the plane on which the arrangement is performed and are at least parallel to one side of the rectangle. Wavefront phase adjustment amounts of all left front areas in any row of radio frequency lenses are strictly monotonically increasing from left to right. Wavefront phase adjustment amounts of all left rear areas in any row of radio frequency lenses are strictly monotonically increasing from left to right. Wavefront phase adjustment amounts of all right front areas in any row of radio frequency lenses are strictly monotonically decreasing from left to right. Wavefront phase adjustment amounts of all right rear areas in any row of radio frequency lenses are strictly monotonically decreasing from left to right. Wavefront phase adjustment amounts of all left front areas in any column of radio frequency lenses are strictly monotonically increasing from front to rear. Wavefront phase adjustment amounts of all left rear areas in any column of radio frequency lenses are strictly monotonically decreasing from front to rear. Wavefront phase adjustment amounts of all right front areas in any column of radio frequency lenses are strictly monotonically increasing from front to rear. Wavefront phase adjustment amounts of all right rear areas in any column of radio frequency lenses are strictly monotonically decreasing from front to rear. If wavefront phase adjustment amounts of two adjacent areas are different, the two adjacent areas belong to two parts. If wavefront phase adjustment amounts of two adjacent areas are the same, the two adjacent areas belong to a same part. The foregoing front-to-rear and left-to-right directions are an arrangement direction of the antenna array. The front-to-rear and left-to-right directions each are symmetrical. To be specific, direction names are interchangeable. FIG. 11 shows a relationship between front-to-rear and left-to-right directions.

Figure 12:
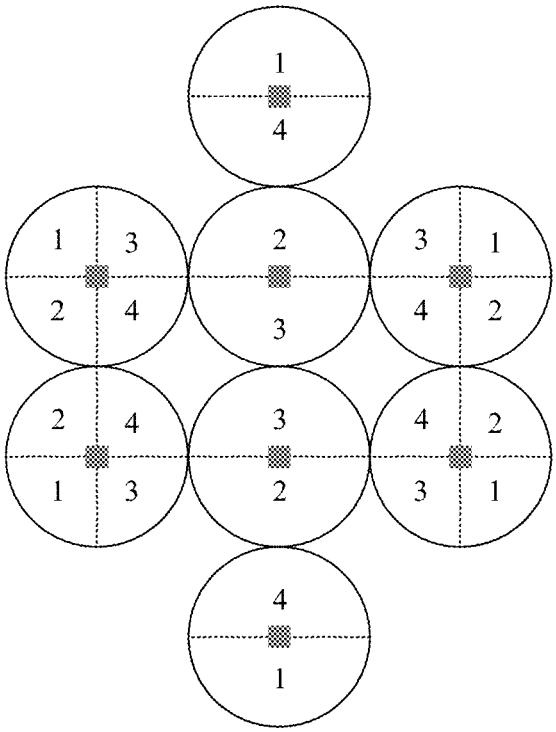
FIG. 12 shows an example 1 of an antenna array arranged as a rhombus according to an embodiment of the present invention.

FIG. 12 shows an example 1 of an antenna array arranged as a rhombus according to an embodiment of the present invention. The antenna array includes eight antennas and eight radio frequency lenses. Each radio frequency lens is divided into two or four parts. Wavefront phase adjustment amounts of the parts are arranged as shown in the figure.

Figure 13:
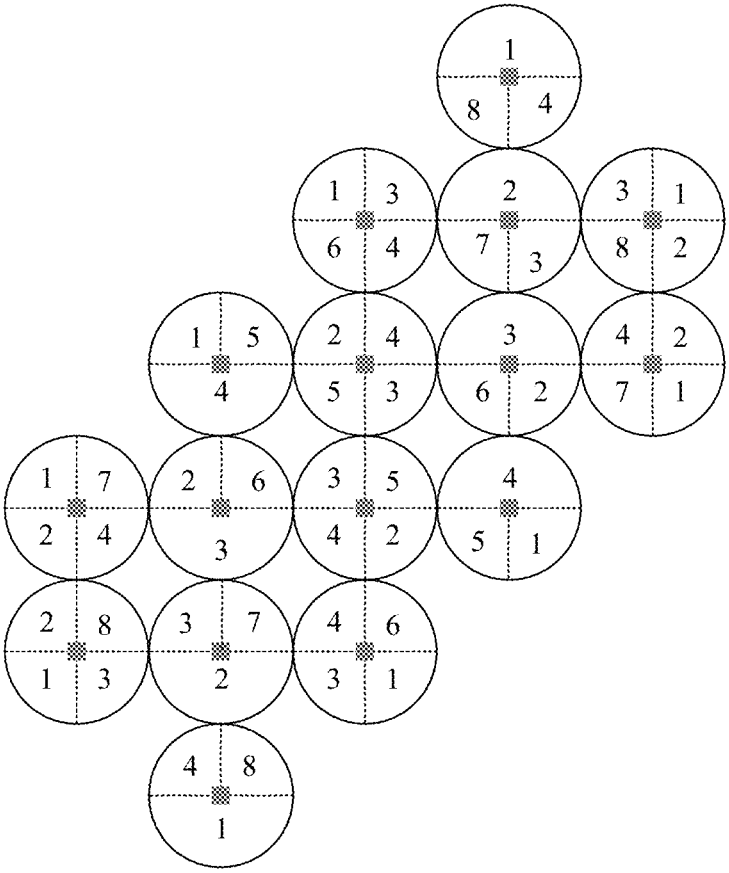
FIG. 13 shows an example 2 of an antenna array arranged as a rhombus according to an embodiment of the present invention.

FIG. 13 shows an example 2 of an antenna array arranged as a rhombus according to an embodiment of the present invention. The antenna array includes 16 antennas and 16 radio frequency lenses. Each radio frequency lens is divided into two, three, or four parts. Wavefront phase adjustment amounts of the parts are arranged as shown in the figure.

Figure 14:
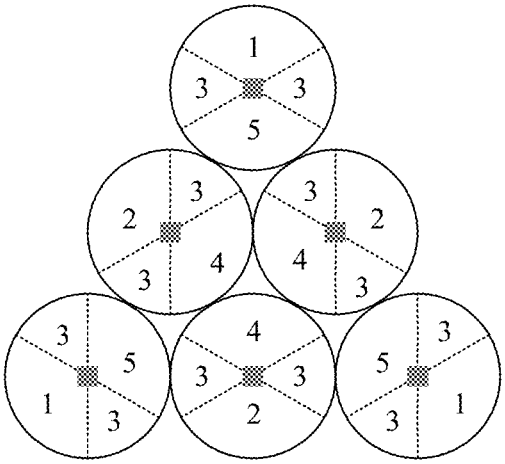
FIG. 14 shows an antenna array arranged as a triangle according to an embodiment of the present invention.

FIG. 14 shows an antenna array arranged as a triangle according to an embodiment of the present invention. The antenna array includes six antennas and six radio frequency lenses. Each radio frequency lens is divided into four parts. Wavefront phase adjustment amounts of the parts are arranged as shown in the figure.

Figure 15:
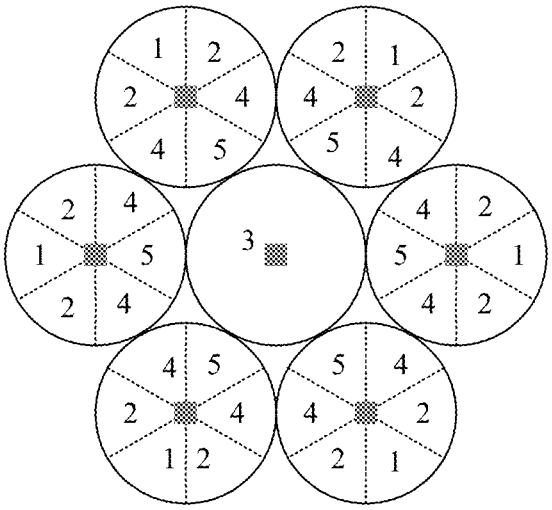
FIG. 15 shows an antenna array arranged as a hexagon according to an embodiment of the present invention.

FIG. 15 shows an antenna array arranged as a hexagon according to an embodiment of the present invention. The antenna array includes one antenna set and one radio frequency lens set, and further includes one separate antenna and one separate radio frequency lens. The antenna set includes five antennas, and the radio frequency lens set includes five radio frequency lenses. Each radio frequency lens in the radio frequency lens set is divided into six parts. The separate radio frequency lens is not divided into a plurality of parts. The radio frequency lenses and wavefront phase adjustment amounts of the parts of the radio frequency lenses are arranged as shown in the figure.

Figure 16:
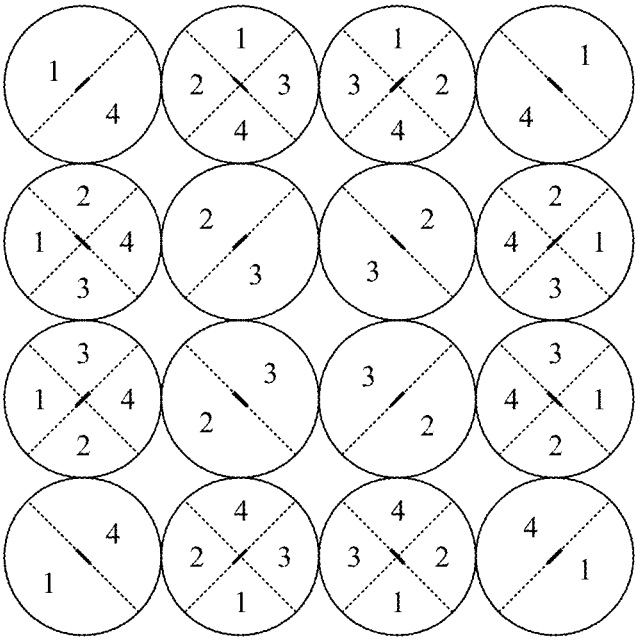
FIG. 16 shows an antenna array including a plurality of independent antenna sets according to an embodiment of the present invention.

FIG. 16 shows an antenna array including a plurality of independent antenna sets according to an embodiment of the present invention. Different antenna sets each include a plurality of antennas in different polarization directions. In the figure, antennas in different directions (which are a 45-degree direction and a 135-degree direction) are used to represent the antennas in the different polarization directions. A first antenna set in the antenna array includes eight antennas, and a first radio frequency lens set includes eight radio frequency lenses corresponding to the antennas in the first antenna set. A second antenna set in the antenna array includes eight antennas, and a second radio frequency lens set includes eight radio frequency lenses corresponding to the antennas in the second antenna set. Each radio frequency lens in the first radio frequency lens set is divided into two or four parts. Wavefront phase adjustment amounts of the parts are arranged as shown in the figure. Each radio frequency lens in the second radio frequency lens set is divided into two or four parts. Wavefront phase adjustment amounts of the parts are arranged as shown in the figure.

Figure 17:
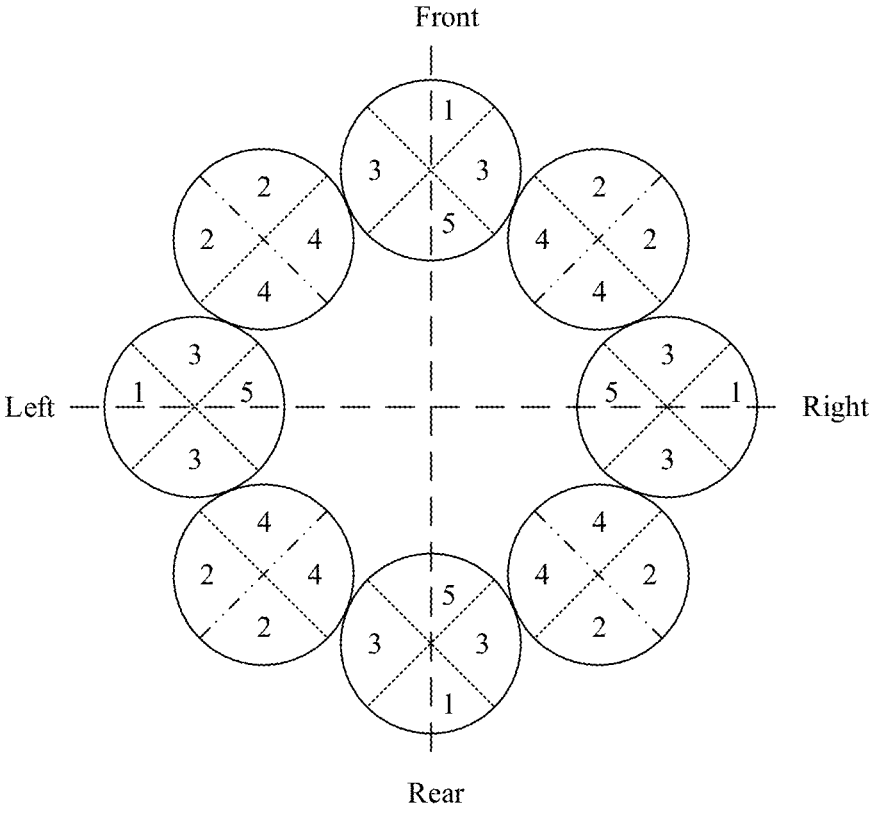
FIG. 17 shows an example of an antenna array arranged as a circle according to an embodiment of the present invention.

In the embodiments shown in FIG. 1 to FIG. 4 and FIG. 8 to FIG. 16, the antennas in each antenna set strictly meet the foregoing three rules. However, for an antenna array arranged as a circle, a complex antenna structure is required to meet all the foregoing requirements. For example, for an antenna array including eight antennas that is arranged as a circle, each antenna needs to be divided into 16 areas to meet all the foregoing requirements. If there are more antennas, a design is more complex, resulting in high manufacturing complexity of the antenna array. To improve MIMO performance of the antenna array per unit size without using an excessively complex structure, an antenna array that partially meets the foregoing requirements may be designed. MIMO performance of the antenna array can be improved provided that the design is used to increase a phase difference between radio signals from at least one pair of antennas at any angle. For example, an antenna array arranged as a circle includes eight antennas arranged in a regular octagon and eight corresponding radio frequency lenses. As shown in FIG. 17, each of these radio frequency lenses includes four areas. Adjacent areas with a same material and structure belong to a same part.

In FIG. 17, different parts are separated by a short dashed line, and adjacent areas belonging to a same part are separated by a dotted line. There are two long dashed lines in FIG. 17, which respectively represent a front-to-rear direction and a left-to-right direction. An angle of 45 degrees is formed between each of the two long dashed lines and each of interfaces between the four areas of each radio frequency lens. As shown in FIG. 17, wavefront phase adjustment amounts of front areas in all radio frequency lenses are strictly monotonically increasing from front to rear. Wavefront phase adjustment amounts of rear areas in all radio frequency lenses are strictly monotonically decreasing from front to rear. Wavefront phase adjustment amounts of left areas in all radio frequency lenses are strictly monotonically increasing from left to right. Wavefront phase adjustment amounts of right areas in all radio frequency lenses are strictly monotonically decreasing from left to right.

FIG. 17 shows an example of an antenna array arranged as a circle according to an embodiment of the present invention. If the antenna array arranged as the circle is larger, the antenna array includes at least eight antennas shown in FIG. 17.

Figure 18:
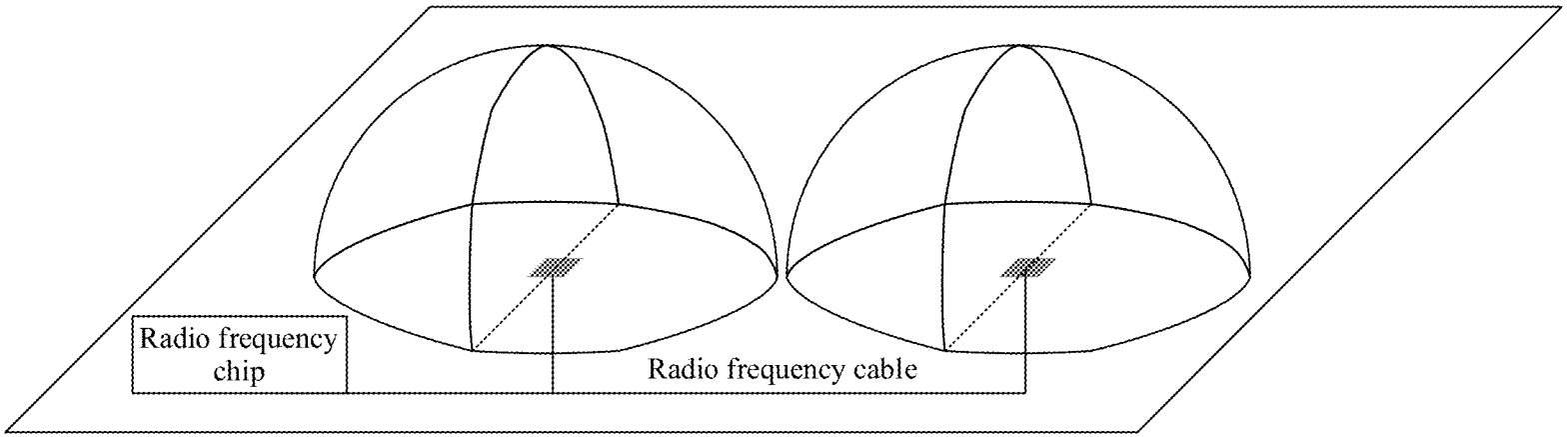
FIG. 18 is a schematic diagram of a wireless device according to an embodiment of the present invention.

Any part of the antenna in the embodiments shown in FIG. 1 to FIG. 3 and FIG. 8 to FIG. 17 may use the structures shown in FIG. 4 to FIG. 7 or any combination thereof. As shown in FIG. 18, an embodiment of the present invention further includes a wireless device that uses the foregoing antenna array. The wireless device further includes a radio frequency circuit, configured to: receive or send signals by using the antenna array. The radio frequency circuit is also referred to as a radio frequency module, and is an electronic device that receives and sends radio frequency signals. The radio frequency circuit may be a separate chip, or may be integrated into another chip. The radio frequency circuit is connected to the antenna array by using a radio frequency cable. When signals are received and sent in an MIMO manner, the antenna array can provide sufficient MIMO performance for the wireless device. For example, the wireless device may be an independent device such as a cellular mobile network device, a wireless local area network (English: wireless local area network, WLAN) device, a Bluetooth device, or a ZigBee (ZigBee) device, or may be modular hardware that cooperates with another device such as an active antenna unit (English: active antenna unit, an AAU) or a remote radio unit (English: remote radio unit, RRU).

The foregoing descriptions are merely specific embodiments of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. An antenna array, comprising:

a first antenna set; and a first radio frequency lens set, wherein the first antenna set comprises a plurality of antennas, the first radio frequency lens set comprises a plurality of radio frequency lenses, and the plurality of antennas in the first antenna set and the plurality of radio frequency lenses in the first radio frequency lens set are arranged according to rules, and the rules comprise:

the plurality of radio frequency lenses are in a one-to-one correspondence with the plurality of antennas, and each radio frequency lens is arranged on a corresponding antenna; and each of the plurality of radio frequency lenses comprises two or more parts with different materials, and dielectric constants of the different materials are different, wavefront phase adjustment amounts of the two or more parts are different, and the wavefront phase adjustment amounts of the plurality of radio frequency lenses in any direction of arrival meet the following conditions:

a plurality of wavefront phase adjustment amounts corresponding to the plurality of radio frequency lenses in a direction of arrival are monotonically increasing along the direction of arrival; and at least two of the plurality of wavefront phase adjustment amounts of the plurality of radio frequency lenses in the direction of arrival are different.

2. The antenna array according to claim 1, wherein the plurality of radio frequency lenses in the first radio frequency lens set are a plurality of dielectric lenses, each of the plurality of dielectric lenses comprises two or more parts with different materials, and dielectric constants of the different materials are different; wavefront phase adjustment amounts of two parts with a same thickness are related to dielectric constants of materials of the corresponding parts, and a larger dielectric constant indicates a larger wavefront phase adjustment amount.

3. The antenna array according to claim 2, wherein the plurality of dielectric lenses are a plurality of dielectric hemispheres, and the plurality of antennas in the first antenna set are respectively located at sphere centers of corresponding dielectric hemispheres in the first radio frequency lens set.

4. The antenna array according to claim 2, wherein a part of at least one dielectric lens in the first radio frequency lens set comprises an anti-reflection structure on a surface of the part, a dielectric constant of a material of the anti-reflection structure is less than a dielectric constant of the part, and a thickness of the anti-reflection structure is one quarter of a wavelength of an electromagnetic wave in the material of the anti-reflection structure.

5. The antenna array according to claim 2, wherein at least one dielectric lens in the first radio frequency lens set comprises a fusion structure that is between an antenna corresponding to the dielectric lens and an interface between parts of the dielectric lens, and a dielectric constant of a material of the fusion structure is less than a smallest dielectric constant of materials of the parts of the dielectric lens.

6. The antenna array according to claim 2, wherein the plurality of antennas in the first antenna set are arranged in a column along a straight line, each dielectric lens comprises two parts that different materials but a same size, and an interface between the two parts is perpendicular to the straight line, and wherein dielectric constants of materials of all left parts in all pairs of the two parts of the plurality of dielectric lenses in the first radio frequency lens set are strictly monotonically increasing along the straight line from left to right, and dielectric constants of materials of all right parts in all pairs of the two parts of the plurality of dielectric lenses in the first radio frequency lens set are strictly monotonically decreasing along the straight line from left to right.

7. The antenna array according to claim 1, wherein the antenna array further comprises a second antenna set and a second radio frequency lens set, the second antenna set comprises a plurality of antennas, the second radio frequency lens set comprises a plurality of radio frequency lenses, and the plurality of antennas in the second antenna set and the plurality of radio frequency lenses in the second radio frequency lens set are arranged according to the rules, and wherein polarization directions of the plurality of antennas in the first antenna set are the same, polarization directions of the plurality of antennas in the second antenna set are the same, and a polarization direction of any antenna in the first antenna set is orthogonal to a polarization direction of any antenna in the second antenna set.

8. An antenna array, comprising:

eight antennas arranged on a plane and eight radio frequency lenses, wherein the eight antennas are arranged in a regular octagon;

the eight radio frequency lenses are in a one-to-one correspondence with the eight antennas, and each radio frequency lens is arranged on a corresponding antenna;

each of the eight radio frequency lenses comprises four areas with a same size;

an angle of 45 degrees is formed between a first straight line along a front-to-rear direction and each of interfaces between the four areas in one of the eight radio frequency lens, and an angle of 45 degrees is formed between a second straight line along a left-to-right direction and each of the interfaces between the four areas in one of the eight radio frequency lens; and wavefront phase adjustment amounts of all front areas in all combinations of the four areas in all of the eight radio frequency lenses are strictly monotonically increasing along the first straight line from front to rear, wavefront phase adjustment amounts of all rear areas in all combinations of the four areas in all of the eight radio frequency lenses are strictly monotonically decreasing along the first straight line from front to rear, wavefront phase adjustment amounts of all left areas in all combinations of the four areas in all of the eight radio frequency lenses are strictly monotonically increasing along the second straight line from left to right, and wavefront phase adjustment amounts of all right areas in all combinations of the four areas in all of the eight radio frequency lenses are strictly monotonically decreasing along the second straight line from left to right.

9. A wireless device, comprising:

an antenna array and a radio frequency circuit coupled to the antenna array, wherein the radio frequency circuit is configured to: receive or send signals by using the antenna array;

the antenna array comprises:

a first antenna set; and a first radio frequency lens set, wherein the first antenna set comprises a plurality of antennas, the first radio frequency lens set comprises a plurality of radio frequency lenses, the plurality of antennas in the first antenna set and the plurality of radio frequency lenses in the first radio frequency lens set are arranged according to rules, and the rules comprise:

the plurality of radio frequency lenses are in a one-to-one correspondence with the plurality of antennas, and each radio frequency lens is arranged on a corresponding antenna; and each of the plurality of radio frequency lenses comprises two or more parts with different materials, and dielectric constants of the different materials are different, wavefront phase adjustment amounts of the two or more parts are different, and the wavefront phase adjustment amounts of the plurality of radio frequency lenses in any direction of arrival meet the following conditions:

a plurality of wavefront phase adjustment amounts corresponding to the plurality of radio frequency lenses in a direction of arrival are monotonically increasing along the direction of arrival; and at least two of the plurality of wavefront phase adjustment amounts of the plurality of radio frequency lenses in the direction of arrival are different.

10. The wireless device according to claim 9, wherein the plurality of radio frequency lenses in the first radio frequency lens set are a plurality of dielectric lenses, each of the plurality of dielectric lenses comprises two or more parts with different materials, and dielectric constants of the different materials are different, wherein wavefront phase adjustment amounts of two parts with a same thickness are related to dielectric constants of materials of the corresponding parts, and wherein a larger dielectric constant indicates a larger wavefront phase adjustment amount.

11. The wireless device according to claim 10, wherein the plurality of dielectric lenses are a plurality of dielectric hemispheres, and the plurality of antennas in the first antenna set are respectively located at sphere centers of corresponding dielectric hemispheres in the first radio frequency lens set.

12. The wireless device according to claim 10, wherein a part of at least one dielectric lens in the first radio frequency lens set comprises an anti-reflection structure on a surface of the part, a dielectric constant of a material of the anti-reflection structure is less than a dielectric constant of the part, and a thickness of the anti-reflection structure is one quarter of a wavelength of an electromagnetic wave in the material of the anti-reflection structure.

13. The wireless device according to claim 10, wherein at least one dielectric lens in the first radio frequency lens set comprises a fusion structure that is between an antenna corresponding to the dielectric lens and an interface between parts of the dielectric lens, and a dielectric constant of a material of the fusion structure is less than a smallest dielectric constant of materials of the parts of the dielectric lens.

14. The wireless device according to claim 10, wherein the plurality of antennas in the first antenna set are arranged in a column along a straight line, each dielectric lens comprises two parts with different materials but a same size, and an interface between the two parts is perpendicular to the straight line, and wherein dielectric constants of materials of all left parts in all pairs of the two parts of the plurality of dielectric lenses in the first radio frequency lens set are strictly monotonically increasing along the straight line from left to right, and dielectric constants of materials of all right parts in all pairs of the two parts of the plurality of dielectric lenses in the first radio frequency lens set are strictly monotonically decreasing along the straight line from left to right.

15. The wireless device according to claim 9, wherein the antenna array further comprises a second antenna set and a second radio frequency lens set, the second antenna set comprises a plurality of antennas, the second radio frequency lens set comprises a plurality of radio frequency lenses, and the plurality of antennas in the second antenna set and the plurality of radio frequency lenses in the second radio frequency lens set are arranged according to the rules, and wherein polarization directions of the plurality of antennas in the first antenna set are the same, polarization directions of the plurality of antennas in the second antenna set are the same, and a polarization direction of any antenna in the first antenna set is orthogonal to a polarization direction of any antenna in the second antenna set.

16. The wireless device according to claim 9, wherein the radio frequency circuit is configured to receive or send the signals by using the antenna array in a multiple-input multiple-output manner.

* * * * *